US005681121A

United States Patent [19]

Ueda

[11] Patent Number: 5,681,121

[45] Date of Patent: Oct. 28, 1997

[54] PRINTER IN WHICH THE AMOUNT OF CARRIAGE TRAVEL CAN BE CHANGED FOR DIFFERENT PRINTING TYPES

[75] Inventor: Hiroyuki Ueda, Yokohama, Japan

[73] Assignee: Canon Kabushiki Kaisha, Tokyo, Japan

[21] Appl. No.: 109,576

[22] Filed: Aug. 17, 1993

Related U.S. Application Data

[63] Continuation of Ser. No. 727,364, Jul. 9, 1991, abandoned, which is a continuation of Ser. No. 539,311, Jun. 18, 1990, abandoned, which is a continuation of Ser. No. 214,820, Jul. 1, 1988, abandoned, which is a continuation of Ser. No. 910,307, Sep. 22, 1986, abandoned, which is a continuation of Ser. No. 620,947, Jun. 15, 1984, abandoned.

[30] Foreign Application Priority Data

| | | | |
|---|---|---|---|
| Jun. 23, 1983 | [JP] | Japan | 58-111805 |
| Jun. 23, 1983 | [JP] | Japan | 58-111806 |

[51] Int. Cl.[6] ..... B41J 19/32

[52] U.S. Cl. ..... 400/303; 400/10; 400/279

[58] Field of Search ..... 400/9, 10, 279, 400/303, 304, 306, 320

[56] References Cited

U.S. PATENT DOCUMENTS

| | | | |
|---|---|---|---|
| 3,729,714 | 4/1973 | Heard | 400/306 |
| 4,074,798 | 2/1978 | Berger | 400/306 |
| 4,169,685 | 10/1979 | Gruber | 400/279 |
| 4,213,714 | 7/1980 | Jones et al. | 400/306 |
| 4,225,249 | 9/1980 | Keltler et al. | 400/306 |
| 4,371,274 | 2/1983 | Jaeger | 400/303 |
| 4,553,866 | 11/1985 | Demente et al. | 400/306 |
| 4,558,965 | 12/1985 | Ueda | 400/144.2 |
| 4,615,631 | 10/1986 | Ueda | 400/705.1 |

FOREIGN PATENT DOCUMENTS

| | | | |
|---|---|---|---|
| 58894 | 5/1981 | Japan | 400/303 |
| 7368 | 1/1983 | Japan | 400/303 |
| 205778 | 11/1983 | Japan | 400/303 |
| 2087115 | 5/1982 | United Kingdom | 400/157.3 |

OTHER PUBLICATIONS

Johnson et al, "Print Condensation . . . " IBM Technical Disclosure Bulletin vol. 13, No. 12 p. 3678 May 1971.

Dooley "Font Identification" IBM Technical Disclosure Bulletin vol. 22, No. 8A p. 305, Jan. 1980.

Booth et al "Scaled tab storage . . . " IBM Technical Disclosure Bulletin vol. 22, No. 12 p. 5399 May 1980.

*Primary Examiner*—Edgar S. Burr

*Assistant Examiner*—Steven S. Kelley

*Attorney, Agent, or Firm*—Fitzpatrick, Cella, Harper & Scinto

[57] ABSTRACT

There is provided a printer comprises a first type group having a first font; a second type group having a second font; a first read only memory in which a space traveling amount corresponding to each type of the first type group has been stored; a second read only memory in which a space traveling amount corresponding to each type of the second type group has been stored; and a microprocessor which selects the 1st read only memory when the 1st type group is used, thereby allowing the propotional spacing operation corresponding to each type of the 1st type group to be performed, and which selects the 2nd read only memory when the 2nd type group is used, thereby allowing the proportional spacing operation corresponding to each type of the 2nd type group to be performed. Since the invention can be constituted by a simple hardware, by merely adding this hardware to a conventional printer such as an electronic typewriter, the fine proportional spacing can be executed for each type of various kinds of fonts.

12 Claims, 3 Drawing Sheets

FIG. 2

| CHARACTER | CONTENTS |
|---|---|
| a | 5 |
| b | 4 |
| ⋮ | ⋮ |
| i | 3 |
| j | 3 |
| k | 5 |
| ⋮ | ⋮ |
| m | 6 |
| n | 5 |
| ⋮ | ⋮ |
| z | 5 |

PSM

PRINTER IN WHICH THE AMOUNT OF CARRIAGE TRAVEL CAN BE CHANGED FOR DIFFERENT PRINTING TYPES

This application is a continuation of application Ser No. 07/727,364 filed Jul. 9, 1991 now abandoned, which is a continuation of application Ser. No. 07/539,311 filed Jun. 18, 1990, now abandoned which is a continuation of application Ser. No. 07/214,820 filed Jul. 1, 1988, now abandoned, which is a continuation of application Ser. No. 06/910,307 filed Aug. 22, 1986, now abandoned, which is a continuation of application Ser. No. 06/620,947 filed Jun. 15, 1984, now abandoned.

BACKGROUND OF THE INVENTION

1. Field of the Invention

The present invention relates to a printer wherein the material on which printing takes place is displaced relative to a printing means such as an electronic typewriter and the like which uses a microprocessor for controlling the displacement and, more particularly, to such a printer which controls the distance the of a carriage travels for as a function or printing type.

2. Description of the Prior Art

Recently, with the development of a microprocessors and the like, printers such as typewriters and the like are changing from the conventional mechanical or electromechanical printers to the electronic controlled printers and a number of so called electronic typewriters has a right margin aligning function and a proportional spacing function, it is difficult to realize these functions with conventional mechanical or electromechanical typewriters.

The proportional spacing function which directly relates to the present invention will now be described. Conventional typewriters of the mechanical type or the like, always have been designed in principle to print ten characters per inch (referred to as "10 pitch") or a function of printing twelve characters per inch (referred to as "12 pitch"). As a result the amount of carriage travel immediately after the printing has been fixed to either 1/10 inch or 1/12 inch irrespective of the wide of the characters. On the other hand, the amount of carriage travel of an electronic typewriter" can be changed in accordance with each character to effect the proportional spacing. The arrangement of characters of a document thus printed is more aseptically acceptable.

In conventional electronic typewriters, only a type group for a single font to effect proportional spacing has been available with respect to each electronic typewriter.

However, recently, different proportional spacing for a plurality of fonts respectively, have been required. Namely, there are desired such an electronic typewriter that can cope with both of the proportional spacing for the conventional type group of 10 characters per inch c.p.i (10 pitch), as a reference and the proportional spacing for the type group of 12 c.p.i. (12) as a reference is desired.

SUMMARY OF THE INVENTION

It is an object of the present invention to provide a printer whereby, in consideration of the above-mentioned points, means necessary to perform an appropriate proportional spacing with respect to a plurality of type groups having different fonts is achieved. This means is constituted by hardware, and by merely adding this hardware to a printer such as a conventional electronic typewriter and the like, fine proportional spacing can be performed for each type.

BRIEF DESCRIPTION OF THE DRAWINGS

FIG. 2 is an explanatory diagram showing an example of the contents of a pitch table shown in FIG. 1.

DETAILED DESCRIPTION OF THE PREFERRED EMBODIMENTS

The present invention now will be described in detail hereinbelow with reference to the drawings.

Figure 1:
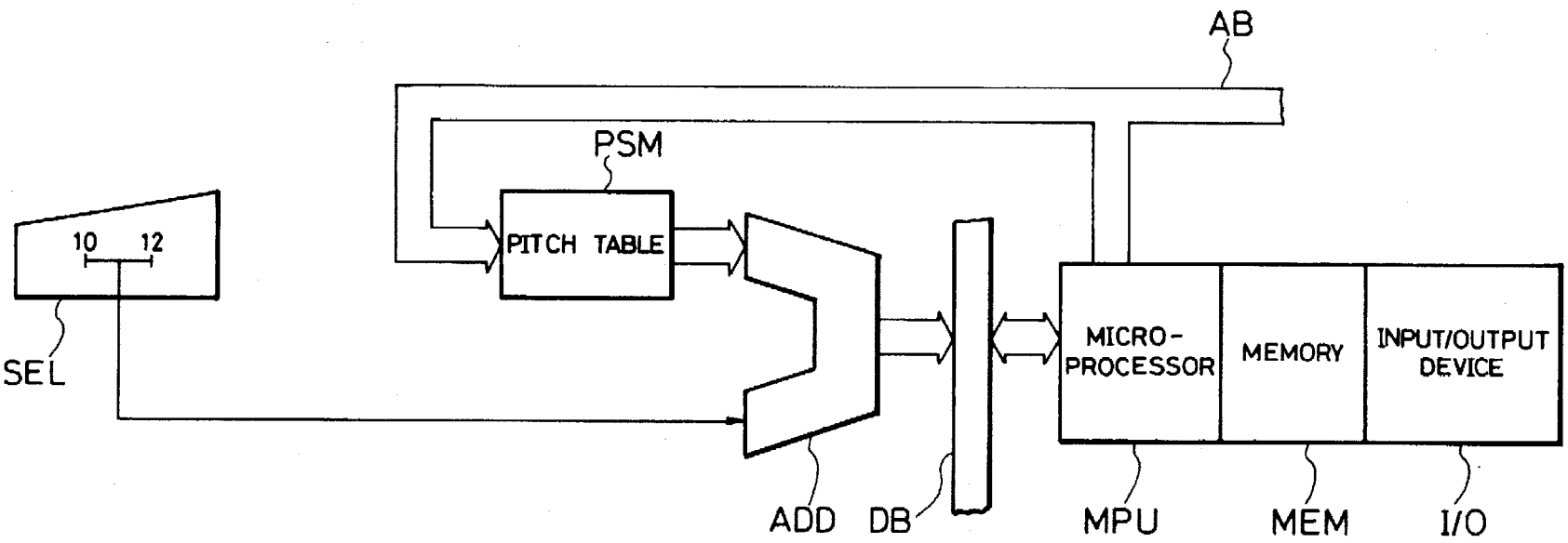
FIG. 1 is a block diagram showing an example of a constitution of a printer according to the present invention.

FIG. 1 shows an example of a printer, e.g., an electronic typewriter, emboding the present invention. In this diagram, SEL denotes a selecting switch to select a reference pitch in the proportional spacing, PSM indicates a read only memory storing a pitch table in which traveling amounts of a carriage (not shown) corresponding to the respective characters constituting different fonts have been preliminarily stored. Outputs of the selecting switch SEL and pitch table PSM are supplied to an adder ADD and an output of this adder ADD is supplied through a data bus DB to a microprocessor MPU.

The microprocessor MPU performs the arithmetic operations, logical discrimination and the like for the printing processing, thereby controlling through the data bus DB and an address bus AB and the like respective components such as the pitch table PSM and the like connected to these buses. MEM represents a memory having a program memory and a work memory, and I/O indicates an input/output device such as a keyboard, a printer and the like. Since the controlling method which is performed primarily by the microprocessor MPU in electronic typewriter is well known, its description is omitted here.

FIG. 2 shows the content of the pitch table PSM wherein a fundamental unit of the traveling amount of its type is set at 1/60 inch . For example, consider a character such as the character "k" which has a character width of 5/60, thus the character "k" has the same amount of carriage travel c.p.i. reference pitch. When character "k" is printed twelve times, 5×12=60. Therefore, the carriage is moved by total of one inch and, in the case, the content is set into 5. Characters having narrower widths, e.g., characters the "i" and "j", each equal 3/60 inch, thereby reducing each amount of carriage than the fundamental pitch. On the contrary, a wider character, e.g., the character "m" is equals 9/60 inch and its traveling amount is greater than the fundamental pitch.

Now, for instance, assuming that the 12 pitch is selected as the reference pitch for the carriage, the selecting switch SEL is set to the position indicated by a mark "12". In the case, a logical value of the output from the selecting switch SEL becomes which is applied to the adder ADD is "0". If the microprocessor MPU accesses the pitch table PSM through the address bus AB to determine the amount of carriage travel; and character in the relevant type group, e.g., An "a" a the value of the amount of carriage travel is read out from the pitch table PSM and is applied to the adder ADD. Therefore, the value of the amount of carriage travel stored in the pitch table PSM and a logical value "0" from the selecting switch SEL are added by the adder ADD. The output of the adder ADD is read in the microprocessor MPU through the data bus DB. Threrfore, the microprocessor MPU controls the carriage so as to obtain the traveling amount of type in response to an output value of the adder ADD.

On the other hand, when a type group of 10 pitch is selected as the reference pitch for the carriage, the selecting switch SEL is set to the location indicated by a mark "10". At this time, a logical value of the output of the selecting switch SEL becomes "1". When the microprocessor MPU accesses the pitch table PSM as mentioned above, the output of the adder ADD becomes a value which is larger by only "1 " than the output of the pitch table PSM. Then, the microprocessor MPU reads out the output of the adder ADD mentioned above and controls the carriage in accordance with its output value. Since conventional technology can be used to effect travel of the carriage itself, its description is omitted here.

The selecting switch SEL has been used as the selecting means for selecting the difference in font types attached to the carriage in this embodiment. It is also possible to use a sensor in place of the switch for automatically discriminating the font types attached to the carriage. The output of the sensor is supplied to the adder ADD. Further although the case use of two types of fonts has been described in this embodiment, it is apparent that the font can be extended easily to three or four type selections.

Figure 3:
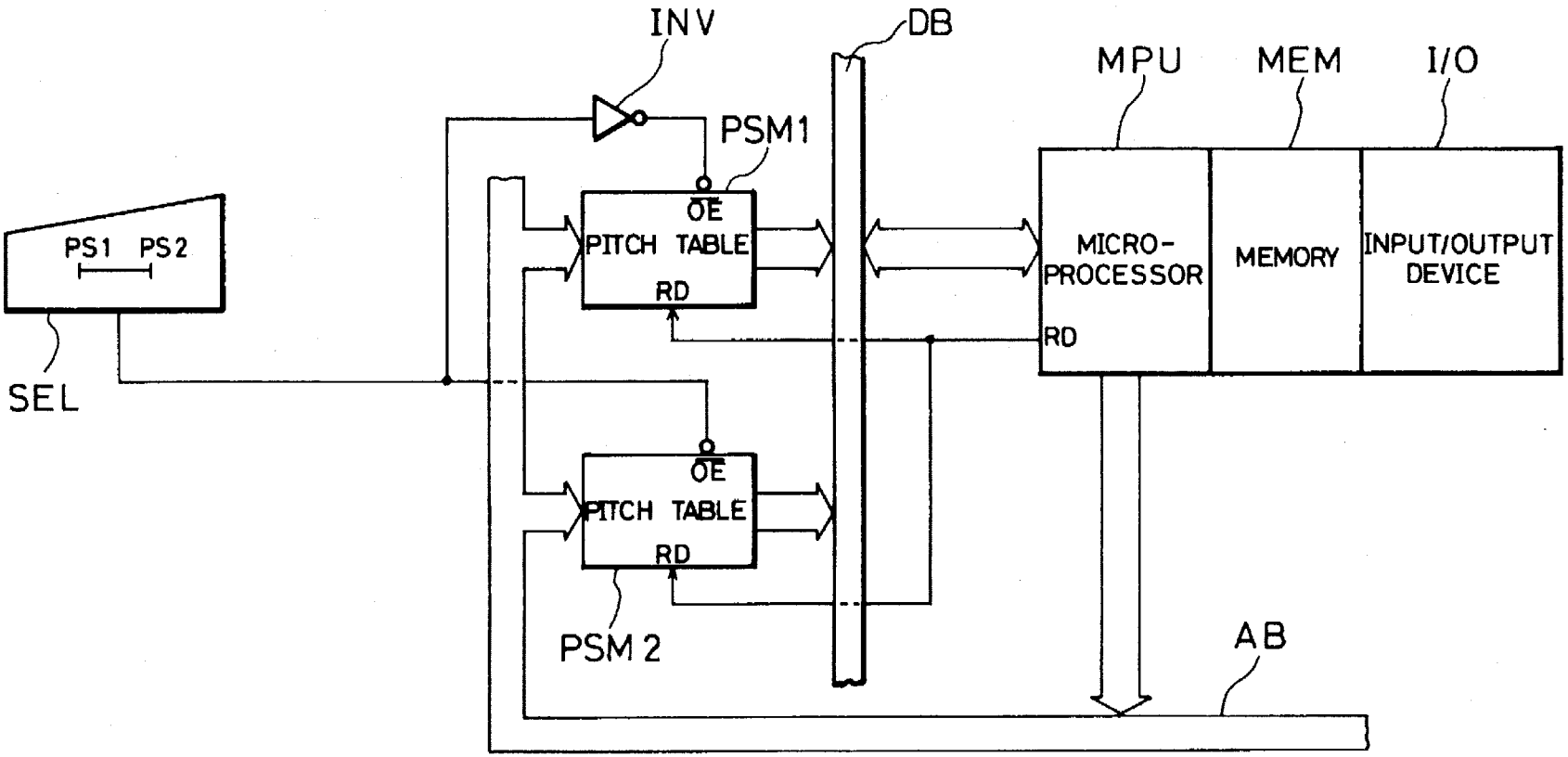
FIG. 3 is a block diagram showing a second embodiment of the present invention.

FIG. 3 shows a second embodiment of an electronic typewriter according to the present invention. In the diagram, SEL is the selecting switch to select which of the fonts PS1 and PS2 which are printed PSM1 and PSM2 are read only memories as pitch tables in which traveling amounts of a carriage (not shown) corresponding to respective characters of the type groups of printing fonts have been preliminarily stored. A font selection output from the selecting switch SEL is supplied to an output terminal $\overline{OE}$ of the pitch table PSM1 through an inverter INV and is also directly supplied to an output terminal $\overline{OE}$ of the pitch table PSM2.

MPU indicates the microprocessor which performs the arithmetic operations, logical discrimination and the like for the printing processing, thereby controlling through the data bus DB, address bus AB the respective components such as pitch tables PSM1 and PSM2 connected to these buses. A readout signal RD from the microprocessor MPU is supplied to the pitch tables PSM1 and PSM2.

MEM denotes the memory which has the program memory and work memory and is connected to the microprocessor MPU; and I/O is the input/output device such as a keyboard, a printer and the like. Since the controlling method which is mainly performed by the microprocessor MPU in the electronic typewriter is well known, its description is omitted here.

Now, assuming that the type group of the font PS1, for example, is attached to the carriage, the selecting switch SEL is set into the location of a mark indicated by "PS1" corresponding to the font PS1. At this time, since a logical value of an output from the selecting, switch SEL becomes "1", a logical value at the output terminal $\overline{OE}$ of the pitch table PSM1 becomes "0", so that the pitch table PSM1 can be used. The microprocessor MPU sends the address corresponding to the character selected onto the address bus AB and sends the readout signal RD to the pitch table PSM1. Thus, the pitch corresponding to the character selected which appears on the data bus DB is read out from the pitch table PSM1, so that the carriage can be moved at a pitch corresponding thereto.

On the other hand, when the selecting switch SEL is set into the location of "PS2" corresponding to the other font PS2, a logical value of the output of the selecting switch SEL becomes "0" and the pitch table PSM2 can be used; therefore, the microprocessor MPU can control the carriage so as to move at a pitch corresponding to the character of the font PS2 in the similar manner as mentioned above. In addition, since a conventional technology can be applied to the traveling of the carriage itself, its description is omitted here.

As described above, in this embodiment, the two pitch tables PSM1 and PSM2 can be easily provided so as to perform the proportional spacings corresponding to two fonts, e.g., pica and elite in place of the conventional storage device in which traveling amounts have been stored. Further, the means for properly selecting either pitch table PSM1 or PSM2 is provided. These constitutions are attained by simple hardware. Therefore, by merely adding such hardware, the proportional spacings corresponding to two kinds of fonts can be easily realized.

In addition, although the selecting switch SEL has been used as the selecting means for selecting the pitch table PSM1 or PSM2 in this embodiment, it is also possible to use a sensor for discriminating the font of types attached to the carriage, thereby selecting a pitch table in accordance with its discrimination output. Furthermore, in this embodiment, the case where two kinds of fonts are used has been described; however, the fonts can be easily extended to three or four kinds. In case of extending the kinds of fonts, it is apparent that the pitch tables and the like may be further added.

As described above, according to the present invention, it is possible to constitute the means necessary to perform appropiate proportional spacings to the type groups of various kinds of fonts by simple hardware. Therefore, by adding this hardware to the conventional printer such as the electronic typewriter and the like, it is possible to obtain a printer which can perform suitable proportional spacings for the type groups of various kinds of fonts. Moreover, the printer of the present invention can be implemented by merely adding simple hardware to the conventional printer; therefore, it is possible to minimize the additional manufacturing cost of the overall unit.

What I claim is:

1. A printing apparatus having a movable carriage on which a plurality of font sets can be mounted, comprising:

memory means, for storing a reference movement amount of the carriage for each font, the reference movement amount corresponding to each font to be printed being read out from said memory means when each font is printed, and for outputting a digital signal representing the reference movement amount;

designation means having a plurality of operation positions corresponding to different spacing modes of the carriage respectively, for designating the different spacing modes by generating different correction amounts of the reference movement amount of each font stored in said memory means, in response to assuming the plurality of operation positions, respectively, and for outputting a digital signal having a logical value of 0 or 1, representing the different correction amounts;

an adder, connected to said memory means and said designation means, for adding the digital signal output by said memory means and the digital signal output by said designation means to generate a movement amount associated with the spacing mode corresponding to the operational position of said designation means; and control means for controlling the movement of the carriage by the movement amount added by said addition means.

2. A printing apparatus according to claim 1, wherein said memory means comprises a read-only-memory.

3. A printing apparatus according to claim 1, wherein said designation means comprises a switch.

4. A printing apparatus according to claim 1, further comprising a device for storing any one of the plurality of different font sets, said device being removably attached to said printing apparatus.

5. A printing apparatus having a movable carriage on which a plurality of font sets can be mounted, comprising:

a first memory, having a terminal, for storing a movement amount of a carriage for a first font style set;

a second memory, having a terminal, for storing a movement amount of a carriage for a second font style set;

a manual font designator, connected to said terminal of said first memory and connected to said terminal of said second memory, for designating the font style set to be used in printing and for inputting selection signals to said terminals of said first and second memories selecting only one of said first and second memories for use in printing with the designated font style set;

processor means connected to said memory means via a bus, for processing the movement amount of the selected memory; and control means for controlling the movement of the carriage in accordance with the processed movement amount.

6. A printing apparatus according to claim 5, wherein said memory means comprises a read-only-memory.

7. A printing apparatus according to claim 5, wherein said designation means comprises a switch.

8. A printing apparatus according to claim 5, further comprising a device for storing any one of the plurality of different font set, said device being removably attached to said printing apparatus.

9. A printing apparatus having a movable carriage on which a plurality of font sets can be mounted, comprising:

a first memory, having a terminal, for storing a movement amount of a carriage for a first font style set;

a second memory, having a terminal, for storing a movement amount of a carriage for a second font style set;

a font designator, connected to said terminal of said first memory and connected to said terminal of said second memory, for designating the font style set to be used in printing and for inputting selection signals to said terminals of said first and second memories selecting only one of said first and second memories for use in printing with the designated font style set;

and controls means for reading out the movement amount from the selected one of said first and second memories to be used in a printing operation.

10. A printing apparatus according to claim 9, wherein said memory means comprises a read-only-memory.

11. A printing apparatus according to claim 9, wherein said designation means comprises a switch.

12. A printing apparatus according to claim 9, further comprising a device for storing any one of the plurality of different font set, said device being removably attached to said printing apparatus.

* * * * *

UNITED STATES PATENT AND TRADEMARK OFFICE

CERTIFICATE OF CORRECTION

PATENT NO. : 5,681,121 
DATED : October 28, 1997
INVENTOR(S) : Hiroyuki UEDA et al.

It is certified that error appears in the above-identified patent and that said Letters Patent is hereby corrected as shown below:

Column 1:

Line 23, delete "of a" and delete "for".
Line 24, "or" should read --of--.
Line 26, "delete "a".
Line 30, "electronic typewriters" should read --electronic typewriters have been proposed. Typically, an electronic typewriter--.
Line 31, "function, it" should read --function. It--.
Line 43, delete """.
Line 46, "aseptically" should read --aesthetically--.

Column 2:

Line 14, "emboding" should read --embodying--.
Line 37, "5/60, thus" should read --5/60. Thus--.
Line 38, "travel c.p.i." should read --travel as the 12 c.p.i.--.
Line 42, "e.g., characters the" should read --e.g., the characters--.
Line 43, delete "thereby reducing each amount of carriage" and insert --i.e., each has a travelling amount less--.
Line 45, "delete "is".
Line 49, "In the" should read --In this--.
Line 51, "delete "becomes".
Line 54, "travel; and" should read --travel of a desired--.
Line 55, "An "a" a the" should read --an a". The --.
Line 61, "Threrfore" should read --Therefore--.

UNITED STATES PATENT AND TRADEMARK OFFICE

CERTIFICATE OF CORRECTION

PATENT NO. : 5,681,121
DATED : October 28, 1997
INVENTOR(S) : Hiroyuki UEDA et al.

It is certified that error appears in the above-identified patent and that said Letters Patent is hereby corrected as shown below:

Column 3:

Line 17, "Further" should read --Further,-.
Line 18, delete "case".
Line 19, "font can" should read --font selection can--.
Line 20, "type selections." should read --types.--.
Line 24, "printed PSMI" should read --printed. PSMI--.
Line 51, "selecting, switch" should read --selecting switch--.

Column 4:

Line 2, delete "a".

Column 6:

Line 3, "set," should read --sets,--. and
Line 27, "set," should read --sets,--.

Signed and Sealed this

Eleventh Day of August 1998

Bruce Lehman

*Attest:*

BRUCE LEHMAN

*Attesting Officer*

*Commissioner of Patents and Trademarks*